US005575408A

United States Patent [19]

Marqueling et al.

[11] Patent Number: 5,575,408

[45] Date of Patent: Nov. 19, 1996

[54] IMAGE DEVELOPER MATERIAL AGITATION SYSTEM WITH NON-BINDING MIXING COIL AGITATOR

[75] Inventors: Virginia A. Marqueling, Webster; A. Lance Marchese, Honeoye Falls; Bruce J. Parks, Bloomfield; Darryl L. Pozzanghera; David B. Playfair, both of Rochester, all of N.Y.

[73] Assignee: Xerox Corporation, Stamford, Conn.

[21] Appl. No.: 430,025

[22] Filed: Apr. 27, 1995

[51] Int. Cl.[6] ..... G03G 15/06

[52] U.S. Cl. ..... 222/412; 222/DIG. 1; 355/260; 366/306

[58] Field of Search ..... 366/186, 194–196, 366/302, 306, 320; 222/333, 412, 413, DIG. 1; 355/245, 260

[56] References Cited

U.S. PATENT DOCUMENTS

| | | | |
|---|---|---|---|
| 4,739,907 | 4/1988 | Gallant | 222/240 |
| 4,943,830 | 7/1990 | Sulenski | 222/413 X |
| 5,139,176 | 8/1992 | Reindl et al. | 222/DIG. 1 X |
| 5,146,277 | 9/1992 | Fox et al. | 222/DIG. 1 X |
| 5,235,389 | 8/1993 | Kikuchi et al. | 355/260 |
| 5,257,077 | 10/1993 | Peters, Jr. et al. | 222/DIG. 1 X |
| 5,289,955 | 3/1994 | Sulenski | 222/413 |
| 5,307,129 | 4/1994 | Miura et al. | 355/260 |

FOREIGN PATENT DOCUMENTS

| | | | |
|---|---|---|---|
| 3-245170 | 10/1991 | Japan | 355/260 |

OTHER PUBLICATIONS

Xerox Disclosure Journal vol. 13, No. 6–Nov./Dec. 1988, pp. 309, 310 Title: Linear Toner Bottle Thumper Author: R. Dray, Jr.

Xerox Disclosure Journal, vol. 13, No. 6–Nov./Dec. 1988, pp. 311, 312 Title: Mechanical Auger Interrupt Authors: Tannascoli, et al.

*Primary Examiner*—Charles E. Cooley

[57] ABSTRACT

A particulate image developer material mixing system for a reproduction apparatus, with a rotatably driven helical mixing coil in a developer material sump for mixing the developer material in the sump, and with a system for holding the rotatably driven helical mixing coil in the sump, and a system for anti-bridging of the developer material by agitating the developer material in the sump by agitating the mixing coil; including a smoothly rounded rod substantially extending inside of the helical mixing coil with a smoothly enlarged diameter end portion outwardly radiused to operatively intermediately engage the mixing coil so that as the helical mixing coil is rotatably driven at least one coil thereof is periodically partially detained and deformed on the smoothly enlarged diameter end portion and then periodically released automatically after a further rotation, so as to provide a periodic anti-bridging agitation of the developer materials, at a desired frequency, and the free end of the helical mixing coil is a sealed coil, and the adjacent rod mounting plate is enlarged to prevent the coil from catching or interleaving on the rod or the mounting plate.

5 Claims, 4 Drawing Sheets

IMAGE DEVELOPER MATERIAL AGITATION SYSTEM WITH NON-BINDING MIXING COIL AGITATOR

Disclosed is an improved developer material agitation system for dry particulate image developer materials for xerographic or other copiers and printers.

In particular, in the specific embodiment hereinbelow, there is disclosed an improved rotating coil type developer material anti-bridging agitation and dispensing system.

More specifically, the embodiment disclosed herein represents an improvement over the developer dispensing apparatus including a helically open coil spring rotated as a "slinky" or "auger" through a developer mixture of toner and carrier beads for its mixing and dispensing as shown in U.S. Pat. No. 5,289,955 issued Mar. 1, 1994 to Timothy J. Sulenski and assigned to Xerox Corporation; and, as illustrated in FIG. 1 labeled "prior art" herein, its commercial application in the Xerox Corporation "4850" and "4890" printing systems.

A helically coiled wire spring auger system has also been utilized per se in or suggested for other developer material dispensing systems, as disclosed for example in Xerox Corporation U.S. Pat. No. 4,739,907 issued Apr. 26, 1988 to Joseph A. Gallant, and two Xerox Disclosure Journal publications in Vol. 13, No. 6, November/December, 1988 by Dray, Jr. and Tannascoli, et al on pages 309–310 and 311–312, respectively. The latter also describes means for creating an intermittent spring vibration in the coil auger to further loosen the developer material and for anti-bridging, as does said U.S. Pat. No. 5,289,955.

Referring further to said U.S. Pat. No. 5,289,955 as to the latter feature, the FIG. 1 holddown shoe 54 and its beveled end surface 56 (a tab thereof) is further described in Cols. 3 and 4 thereof, with specific reference to the operation for providing a thumping action which serves as an anti-bridging function. As described therein, in operation, when the spring auger 40 is rotated by a motor, the auger end area 40*a* begins to partially wind up, depending on the number of coils constrained by the shoe 54, to store energy. At some point, this resistance to rotation is overcome, and these coils "slip" back to their normal rotational position, and thereby release their stored energy, which is transferred to the surrounding developer material to provide a thumping action for an anti-bridging function. It is stated that this occurs at a predictable frequency.

The disclosed system here generally utilizes but provides substantial improvements overcoming problems which have been encountered with the specific embodiment of said prior art system in the above-cited "4890" printer product. The current holddown bracket therein, while eliminating the previous tendency of the wire coil to ride up on top of carrier beads at the bottom of the developer mix, has experienced some failure modes in some cases. In some cases, the open or free end of the coil catches on the holddown bracket and stops the rotation; or the open end of the coil slips over the relatively flat holddown bracket so that the bracket becomes interleaved between the coils of the wire; or similar catching or binding or interleaving occurs with the end of the holddown bracket intermediately of the coil. It has been found that the new coil and coil holddown system disclosed in the embodiment herein overcomes these and other problems. The disclosed embodiment eliminates sharp or flat surfaces on which the coil can become caught or interleaved, and also eliminates the open end of the coil, and provides more dependable and regular antibridging agitation.

As further explained in said U.S. Pat. No. 5,289,955, holding down the coil spring auger to near the bottom of the container or sump containing the developer material is particularly important in a development system in which the developer material contains some quantity of carrier particles as well as toner material. Such a mixture is provided, for example, in a "trickle" development system in which carrier as well as toner is gradually replenished into a two component developer system from such a dispenser. Trickle development is further described for example in Xerox Corporation U.S. Pat. Nos. 4,614,165; 4,891,673; and 5,095,338. Carrier beads are much larger and heavier than the toner particles, and thus have a tendency to settle to the bottom of the dispensing and/or mixing container. The rotating coil auger can provide thorough mixing thereof only by being maintained in a position to mix the carrier beads up from adjacent the bottom of the container. The coil holddown system is intended to inhibit the riding up of the coil on carrier beads at the bottom of the dispenser, as discussed in said U.S. Pat. No. 5,289,955.

"Bridging" refers to the tendency of a quantity of dry developer material to form voids when the material is fed out from the bottom thereof. The overlying material can form "bridges" which fail to drop unless the material is mechanically agitated by some sort of vibration or stirring, either by direct contact internally of the material, as here, or by "thumping" of the exterior of the container. However, the latter has been found to be more noisy and otherwise less suitable.

A specific feature of the specific embodiment disclosed herein is to provide a particulate image developer material mixing system for a reproduction apparatus, with a rotatably driven helical mixing coil in a developer material sump for mixing said developer material in said sump, and with a system for holding said rotatably driven helical mixing coil in said sump, and a system for anti-bridging of said developer material by agitating said developer material in said sump by agitating said mixing coil; the improvement comprising a smoothly rounded rod extending inside of said helical mixing coil through a substantial portion thereof, said smoothly rounded rod having a smoothly enlarged diameter end portion operatively intermediately engaging said mixing coil so that as said helical mixing coil is rotatably driven at least one coil thereof is periodically partially detained and deformed on said smoothly enlarged diameter end portion and then periodically released automatically after a predetermined rotation of said helical mixing coil, so as to provide a periodic anti-bridging agitation of said developer materials with said released helical mixing coil at a desired frequency as said helical mixing coil is rotated.

Further specific features disclosed herein, individually or in combination, include those wherein said smoothly enlarged diameter end portion is outwardly radiused; and/or wherein said helical mixing coil defines a free end; said smoothly rounded rod extends into said free end of said helical mixing coil, and said open end of said helical mixing coil has a sealed end coil to prevent said rod from catching thereon; and/or wherein said smoothly enlarged diameter end portion is sized to prevent said helical mixing coil from interleaving and binding on said rod; and/or wherein said rod is mounted from a mounting plate at one end of said sump, and said mounting plate is sized larger than said free end of said helical mixing coil so that said helical mixing coil cannot bind or ride over said mounting plate.

Various of the above-mentioned and further features and advantages will be apparent from the specific apparatus and its operation described in the example below, as well as the claims. Thus, the present invention will be better understood from this description of the embodiment thereof, including the drawing figures (approximately to scale) wherein:

FIG. 1, labeled "prior art", illustrates the discussed prior art Xerox Corporation "4890" developer agitation and dispensing system, including the above-discussed hold-down bracket (also shown in FIG. 1 of the above-cited U.S. Pat. No. 5,289,955), although for illustration clarity only a small broken area is shown with the developer material mixture, and the wire coil is also shown partially broken away;

Figure 2:
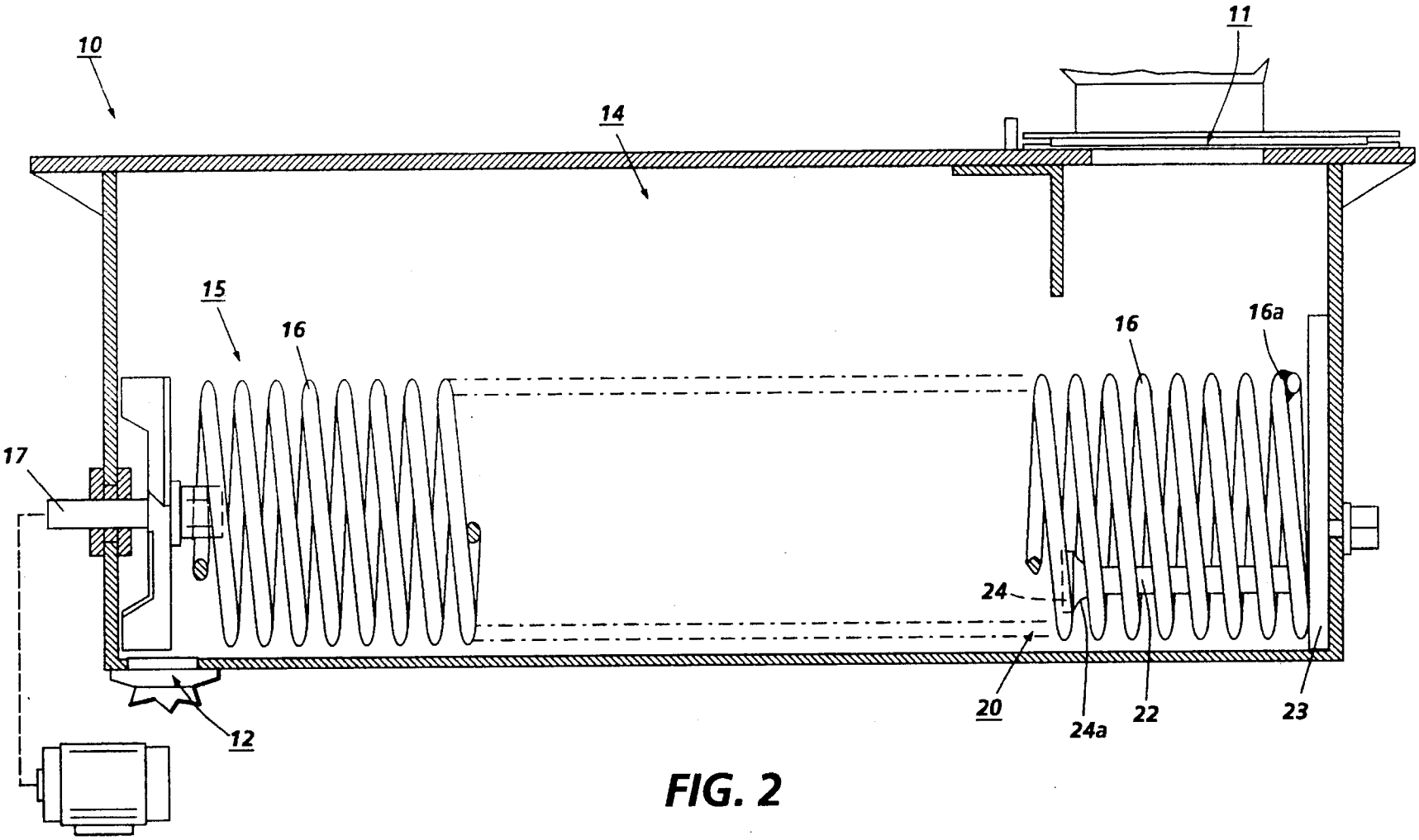
FIG. 2 illustrates, in contrast, in a cross-sectional plan view similar to FIG. 1, one example of the subject improved developer material agitation and mixing system.
Figure 3:
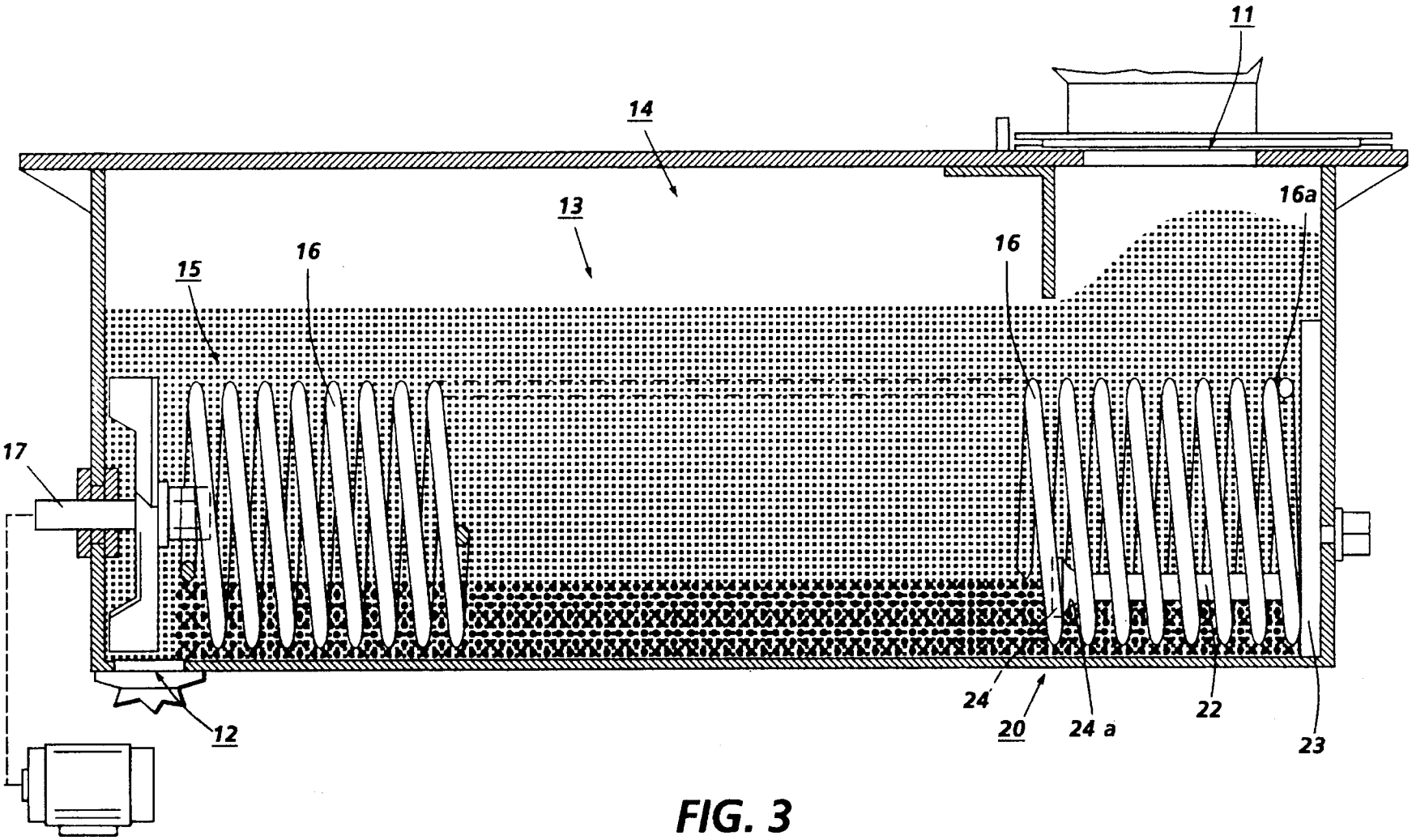
FIG. 3 is similar to FIG. 2, but illustrates the mixing container filled with developer material with a schematic illustration (exaggerated) of the separation from the toner of the carrier beads on the bottom of the sump to illustrate the above-discussed mixing problem.
Figure 4:
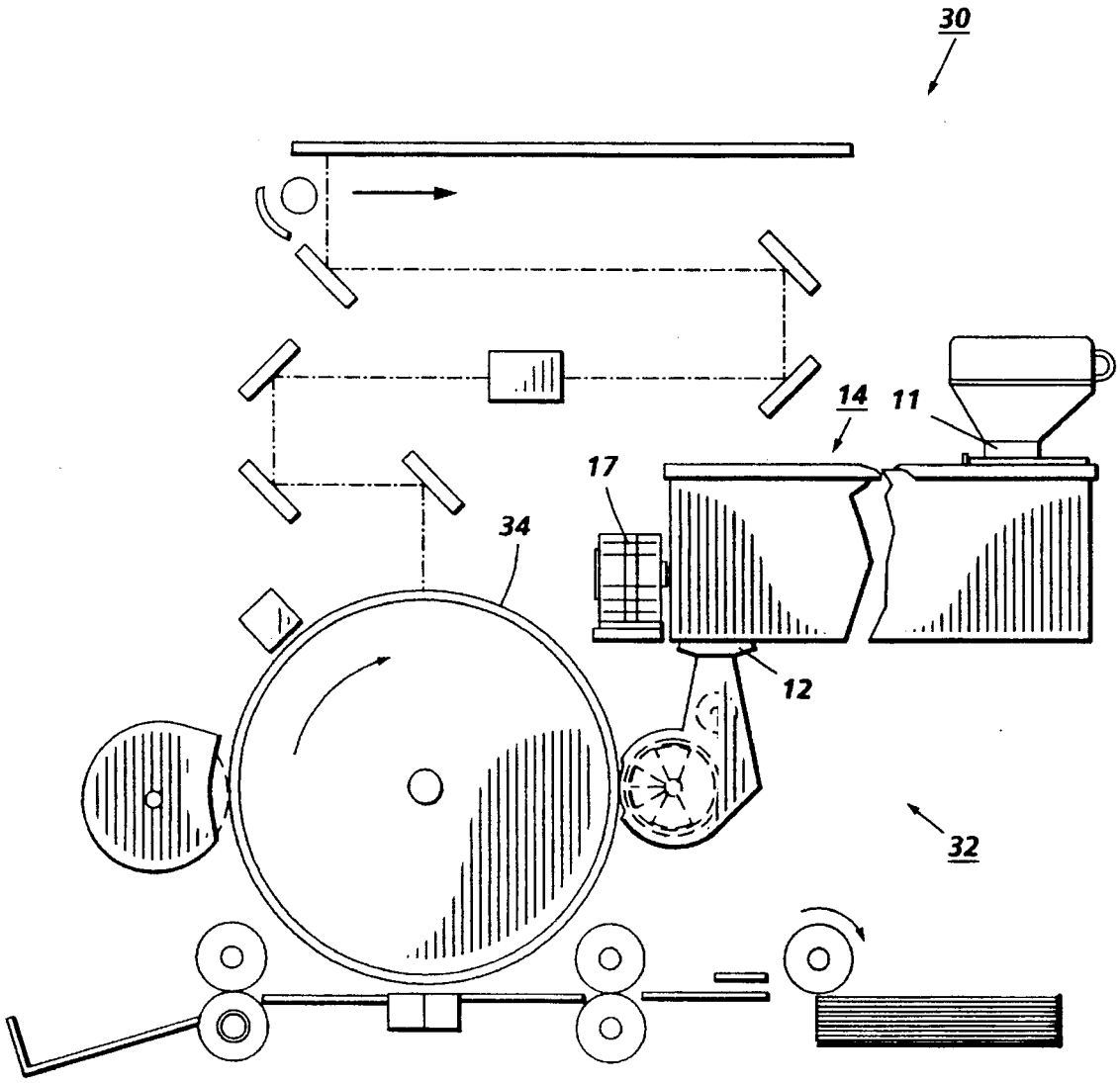
FIG. 4 PRIOR ART

FIG. 4, also labeled "prior art", is essentially FIG. 3 of said U.S. Pat. No. 5,289,955, illustrating schematically how the improved mixing and agitation system of FIGS. 2 and 3 may be similarly incorporated into a copier or printer development system, by way of one example thereof.

The presently disclosed system provides the desired holddown of the wire coil auger, and also the desired anti-bridging function of temporarily intermittently engaging and then releasing the rotating coil, yet eliminates protruding edges and flat surfaces and other coil catching or binding problems. In particular, as disclosed, the anti-bridging excitation action of the coil spring auger has been substantially improved in reliability. Note particularly the illustrated smooth radius of curvature of a "horn" at the end of a holddown rod. Also preferably provided are an increased wire diameter and spring constant to more appropriately excite the wire coil anti-bridging action.

Referring specifically to FIGS. 2 and 3, there is disclosed an improved developer mixing and dispensing system 10 with a developer material hopper inlet 11 and outlet 12 for the developer material 13, which is described in this example as a mixture of toner and a smaller (but larger diameter and heavier) quantity of intermixed carrier beads. In the system 10, these two materials are being mixed in the mixing chamber 14 by the auger unit 15, comprising a rotatably driven coiled wire helix 16.

In this example, the diameter of the wire forming the helical mixing coil 16 has been increased from 1.6 mm to 1.8 mm, which enables the coil 16 or "slinky" to translate spring tension from its driving end to its free end even in packed material, and even at temperatures of over 115° F., at which temperature some toner materials tend to become sticky and begin to clump or aggregate and pack together and thus tend to bind the mixing coil 16 as it is driven.

Figure 1:
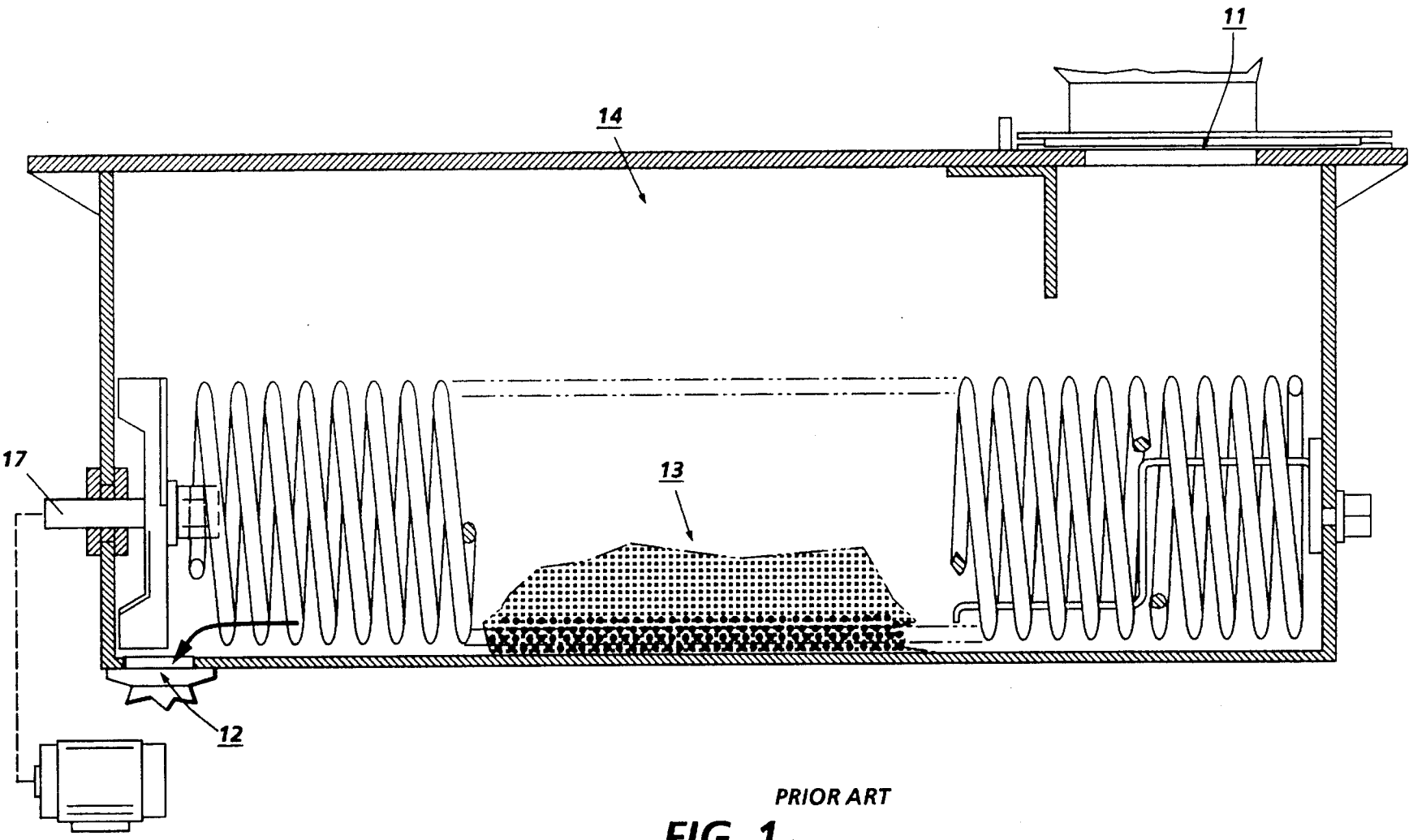
PRIOR ART FIG. 1

Here, as in the prior art system of FIG. 1, a rotational auger drive 17 is connected to one end of the wire mixing coil 16 for continuous rotation during operation. The other end of this wire helix 16 is free. Here, however, the end of the wire itself is closed by welding or the like at 16*a* so that there is no pitch or coil opening into the coils of the mixing auger coil 16 at its free end. The end of the wire is terminated at 16*a* by welding or soldering it onto the last coil of the helix 16. This closed end helps eliminate previous problems of interleaving or catching thereof on the prior holddown bracket, as described above.

Turning now to the new holddown and antibridging excitation system 20 illustrated in FIGS. 2 and 3, it may be seen that it comprises a generally cylindrical rod 22 which extends inside of the helical mixing coil 16, along the bottom thereof, from the free end, through a substantial portion thereof. This rod 22 has a sufficiently smoothly arcuate surface, i.e. a sufficiently large radius in diameter so as not to provide any opportunity for catching on, or interleaving with any portion of the coiled wire 16, either at the mounting base or end plate 23 of the rod 22 at one end of the mixing chamber 14, or anywhere along the entire length of the rod 22. The rod 22 is in the lower interior of the coil 16 so as to ensure a holddown or anticlimbing force on that end of the coil 16.

The outer or cantilevered end of the rod 22 inside the helix 16 has a unique horn shaped enlarged diameter end bell 24, including a slightly concavely radiused transitional surface 24*a*. This end bell 24 extends slightly into, i.e., between, individual turns or coils of the wire helix 16, so as to provide the periodic excitation for antibridging action as the helix 16 is rotated by its drive 17. This peculiar horn or end bell shape has been found to provide considerably more dependable such action with greatly reduced danger of binding or seizing of the coil helix 16. This end bell 24, and particularly the radiused surface 24*a*, help prevent the system 20 from becoming interleaved between coils, both during parts assembly and in operation, in spite of the much larger helix 16 internal diameter and its quite open pitch configuration.

Also note that the end wall mounting plate 23 to which the secured end of the cantilevered rod 22 is mounted is sufficiently large such that no gaps exist between the edge of the plate 23 and the inside surface of the mixing chamber 14, thus preventing the possibility of the coil 16 catching or binding on any part of the holddown and antibridging system 20. Further, the top of the mounting plate 23 is high enough to prevent the coil from riding above it when elevated by developer material in the bottom of the mixing chamber.

The end bell 24 here is, as shown, generally bell shaped with a generally radiused surface 24*a*, smoothly transitioning with this radial surface 24*a* between the smaller diameter of the rod 22 and the larger end diameter of this end bell 24. As a coil of the helix 16 rides thereover, it can slide on and release off of the radiused surface 24 after a sufficient spring force has been developed, i.e., after a sufficient number of coils have been wound up under tension or compression between the end bell 24 and the mounting end plate 22 on one hand and between the end bell 24 and the auger drive 17 end of the helix 16 on the other hand. As the helical mixing coil 16 is rotatably driven, at least one coil thereof is thus periodically partially detained and spring deformed on said smoothly enlarged diameter end portion 24, and then periodically released therefrom automatically after a predetermined desired further rotation of the helical mixing coil 16, so as to provide a consistent and sufficient antibridging agitation of the developer materials upon this release of the helical mixing coil at a desired frequency as said coil is rotated by the drive 17. This operation, in general terms of its antibridging function, is otherwise further described above and in said U.S. Pat. No. 5,289,955, etc.

Although the above described embodiment is a mixing and dispensing system, which, as shown in FIG. 4, is intermediate the operator insertable container of new developer material, and the connecting photoreceptor image development station therebelow into which it dispenses the mixed developer and carrier, it will be appreciated that the system described herein may have other applications. For example, a variant of this system could be used in the sump of the photoreceptor image development station itself for the well known triboelectric charging and mixing of the developer and carrier there, as is well known in any conventional two component development system. It could also break up inadvertent toner agglomerates there also. That is, the described system is not necessarily limited to a material dispenser or to being in the material dispensing path, as described above.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a particulate image developer material mixing system for a reproduction apparatus, with a rotatably driven helical mixing coil in a developer material sump for mixing said developer material in said sump, and with a system for holding said rotatably driven helical mixing coil in said sump, and a system for anti-bridging of said developer material by agitating said developer material in said sump by agitating said mixing coil; the improvement comprising:

a smoothly rounded rod extending inside of said helical mixing coil through a substantial portion thereof, said smoothly rounded rod having a smoothly enlarged diameter end portion operatively intermediately engaging said mixing coil so that as said helical mixing coil is rotatably driven at least one coil thereof is periodically partially detained and deformed on said smoothly enlarged diameter end portion and then periodically released automatically after a predetermined rotation of said helical mixing coil, so as to provide a periodic anti-bridging agitation of said developer material with said at least one released coil at a desired frequency as said helical mixing coil is rotated.

2. The image developer material mixing system of claim 1, wherein said smoothly enlarged diameter end portion is smoothly outwardly radiused.

3. The image developer material mixing system of claim 1, wherein said helical mixing coil defines a free end, and said smoothly rounded rod extends into said free end of said helical mixing coil, and wherein said free end of said helical mixing coil has a sealed end coil to prevent said rod from catching said free end.

4. The image developer material mixing system of claim 1, wherein said smoothly enlarged diameter end portion is sized to prevent said helical mixing coil from interleaving and binding on said rod.

5. The image developer material mixing system of claim 1, wherein said rod is mounted from a mounting plate at one end of said sump, and said mounting plate is sized larger than a free end of said helical mixing coil so that said helical mixing coil cannot bind or ride over said mounting plate.

* * * * *